United States Patent [19]

Ibuchi et al.

[11] Patent Number: 5,016,053

[45] Date of Patent: May 14, 1991

[54] STIRRER ROLLER OF DEVELOPING DEVICE IN ELECTROPHOTOGRAPHIC COPYING MACHINE

[75] Inventors: Yoshiaki Ibuchi; Yoshikazu Nishikawa, both of Nara, Japan

[73] Assignee: Sharp Kabushiki Kaisha, Osaka, Japan

[21] Appl. No.: 489,796

[22] Filed: Mar. 5, 1990

Related U.S. Application Data

[63] Continuation of Ser. No. 368,069, Jun. 15, 1989, abandoned, which is a continuation of Ser. No. 256,185, Oct. 6, 1988, abandoned, which is a continuation of Ser. No. 134,563, Dec. 18, 1987, abandoned, which is a continuation of Ser. No. 934,005, Nov. 24, 1986, abandoned.

[30] Foreign Application Priority Data

Nov. 29, 1985 [JP] Japan ..... 60-185268[U]

[51] Int. Cl.[5] ..... G03G 15/06

[52] U.S. Cl. ..... 355/245; 118/653

[58] Field of Search ..... 118/653, 658; 355/245

[56] References Cited

U.S. PATENT DOCUMENTS

| | | | |
|---|---|---|---|
| 3,926,517 | 12/1975 | Nagahara | 355/3 DD |
| 4,449,810 | 5/1984 | Ikesue et al. | 118/658 X |
| 4,559,898 | 12/1985 | Fukuchi et al. | 118/653 |
| 4,647,180 | 3/1987 | Watanabe | 355/3 DD |

*Primary Examiner*—A. D. Pellinen
*Assistant Examiner*—Marc S. Hoff
*Attorney, Agent, or Firm*—Flehr, Hohbach, Test, Albritton & Herbert

[57] ABSTRACT

A stirrer roller of a developing device for electrophotography has elliptical plates obliquely attached to an axis such that they are mutually parallel and their projections in the directions of the axis are circular. Each plate has notches or holes symmetrically positioned with respect to the center such that the trajectories of these notches do not overlap when the roller rotates around its axis.

6 Claims, 4 Drawing Sheets

STIRRER ROLLER OF DEVELOPING DEVICE IN ELECTROPHOTOGRAPHIC COPYING MACHINE

This is a continuation of application Ser. No. 368,069 filed June 15, 1989, now abandoned, which is a continuation of application Ser. No. 256,185 filed Oct. 6, 1988 and now abandoned, which is a continuation of application Ser. No. 134,563 filed Dec. 18, 1987 and now abandoned, which is a continuation of application Ser. No. 934,005 filed Nov. 24, 1986 and now abandoned.

BACKGROUND OF THE INVENTION

This invention relates to a stirrer roller developing device in an electrophotographic apparatus such as a copying machine and more particularly to a stirrer roller of a developing device having notches or holes in elliptical plates attached to its axis such that developing agent can be stirred evenly and dependably.

A common developing device for use in electrophotography in which a stirrer roller of the present invention may be used is illustrated in FIG. 4. With reference to FIG. 4, a photosensitive drum 1 and a developer roller 2 rotate in opposite directions as shown by respective arrows and a two-component developing agent 3 including carrier and toner converts latent images on the surface of the photosensitive drum 1 into visible images. Toner is supplied from a hopper 4 and a stirrer roller 5 is disposed behind the developer roller 2 to uniformly mix the supplied toner in the agent 3. As shown in FIGS. 5 and 6, a kind of stirrer roller previously considered is composed of a plurality of elliptical plates 6 affixed obliquely to an axis 7 at such angles that they are parallel to one another and appear as a circle when seen in the axial direction. With a stirrer roller of this type, the developing agent can be stirred satisfactorily in directions towards the peripheries but its axial motion remains local and the overall stirring of the toner supplied from the hopper 4 is not carried out efficiently. For this reason, a stirrer roller shown in FIGS. 7 through 9 has also been considered. This stirrer roller is different from the one shown in FIGS. 5 and 6 in that U-shaped notches 8 are provided to the elliptical plates 6 along their minor axes such that the developer agent 3 can easily move in axial direction and hence that the toner can be stirred more effectively as a whole. When this roller 5 rotates around its axis 7, however, the ring-like trajectories of these notches 8 become superposed one on top of another and the force tending to move the developing agent 3 toward the periphery becomes weak in such places, reducing the height of the developing agent (h in FIG. 4) locally. For this reason, the toner from the hopper 4 gathers at such places where the height of the developing agent is locally reduced and moves toward the developing roller 2 without becoming mixed uniformly. This tends to cause unevenness in the image density, thereby adversely affecting the image quality.

SUMMARY OF THE INVENTION

It is therefore an object of the present invention to provide a stirrer roller of a developing device in an electrophotographic copying machine which is capable of stirring developing agent evenly.

The above and other objects of the present invention are achieved by providing a stirrer roller with a plurality of elliptical plates which are obliquely affixed to its axis of rotation such that their projections in the axial direction are circular, each plate having notches or holes symmetrically with respect to its center such that their ring-like trajectories when the stirrer roller is rotated around its axis do not overlap one another. Each elliptical plate is affixed to the axis such that its minor axis is perpendicular thereto. If notches are formed on the plate symmetrically with respect to its major axis, therefore, their trajectories overlap when the stirrer roller is rotated as mentioned above. Thus, the notches must be formed symmetrically with respect to the center of the ellipse but not with respect to its major axis. The number of notches formed on each plate need not be two. More than one pair of notches may be formed on each plate.

If a stirrer roller is designed like this, the notches tend to spur the motion of the developing agent in the axial direction and the effects of stirring do not remain local. Since the notches are symmetrically located with respect to the center of each elliptical plate, motion of the developing agent remains in the axial direction without deviation into any particular radial direction. Moreover, since the notches are so located that their trajectories do not overlap when the stirrer roller is rotated around its axis, there is no sudden drop in the pressure which tends to push the developing agent toward the periphery and the level of the developing agent can be maintained uniformly. Accordingly, a stirrer roller of the present invention can mix the developing agent uniformly both locally and as a whole and images of improved quality can be obtained.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
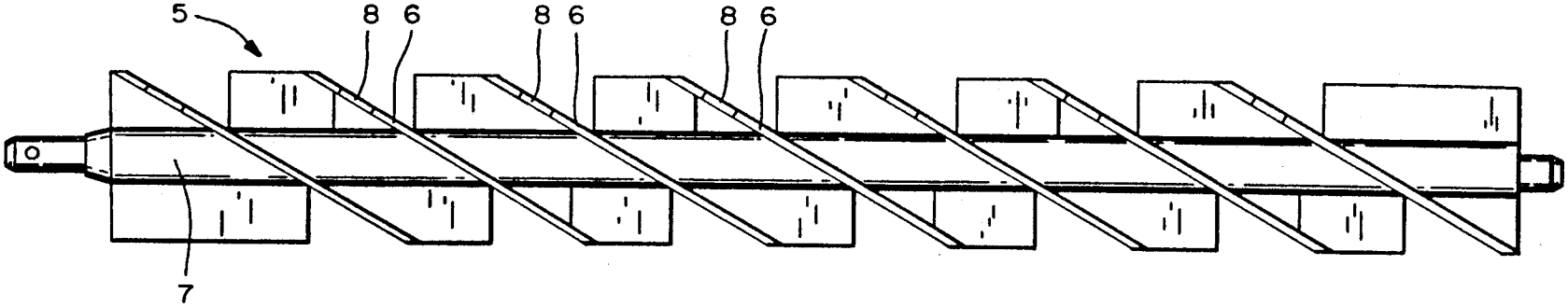
FIG. 1 is a plan view of a stirrer roller embodying the present invention.
Figure 2:
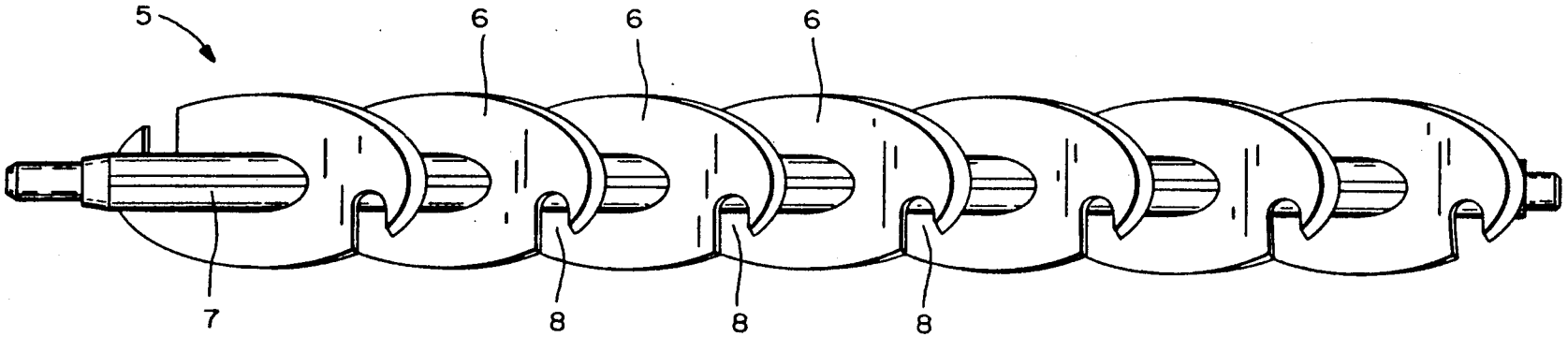
FIG. 2 is a front view of the stirrer roller of FIG. 1.
Figure 7:
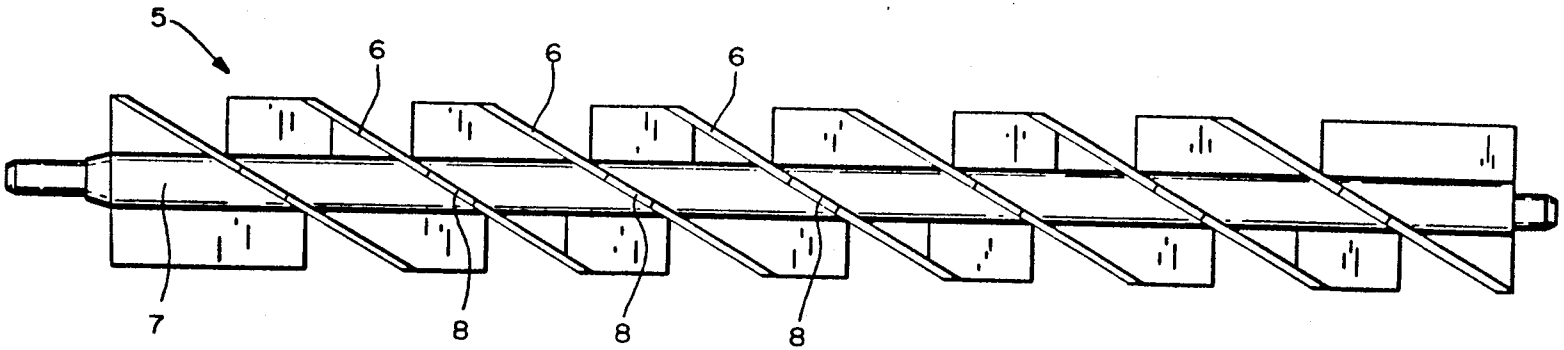
FIG. 7 is a plan view of another stirrer roller considered previously.
Figure 8:
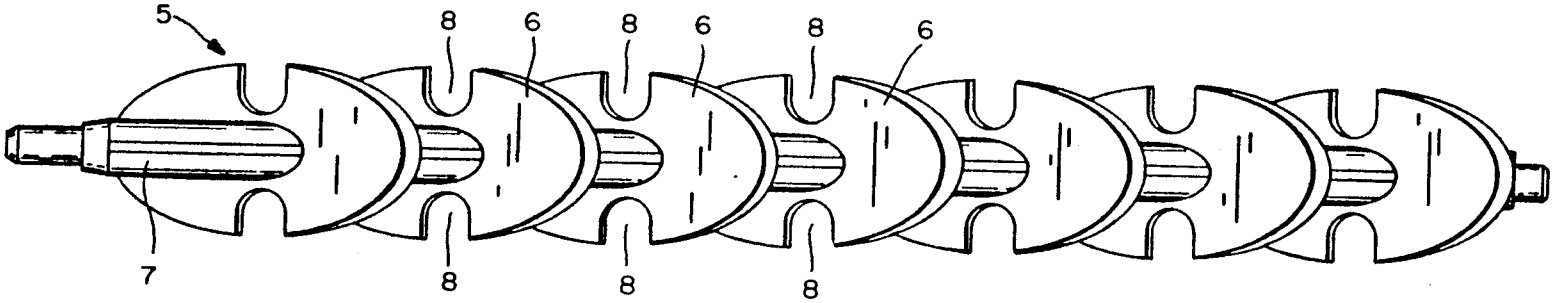
FIG. 8 is a front view of the stirrer roller of FIG. 7.
Figure 9:
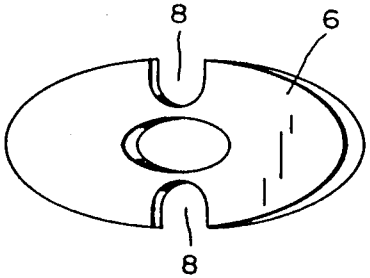
FIG. 9 is a front view of one of the elliptical plates of the stirrer roller of FIGS. 7 and 8.
Figure 3:
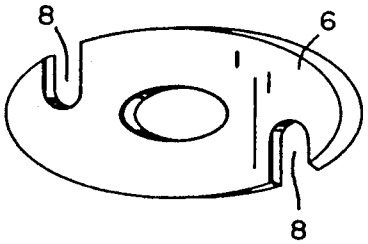
FIG. 3 is a front view of one of the elliptical plates of the stirrer roller of FIGS. 1 and 2.

FIGS. 1 and 2 show a stirrer roller 5 according to the present invention having seven elliptical plates 6 obliquely affixed to a roller axis 7 such that they are parallel to one another and their projections in the direction of the roller axis 7 are circular. According to this embodiment of the present invention illustrated in FIGS. 1 and 2, each of the elliptical plates 6 have two U-shaped notches 8 as best shown in FIG. 3 such that they are both parallel to its minor axis and formed in opposite directions with respect to each other and symmetrically with respect to the center of the ellipse.

Moreover, these notches 8 are so positioned that their ring-like trajectories when the stirrer roller 5 is rotated around the axis 7 do not overlap with one another.

Figure 4:
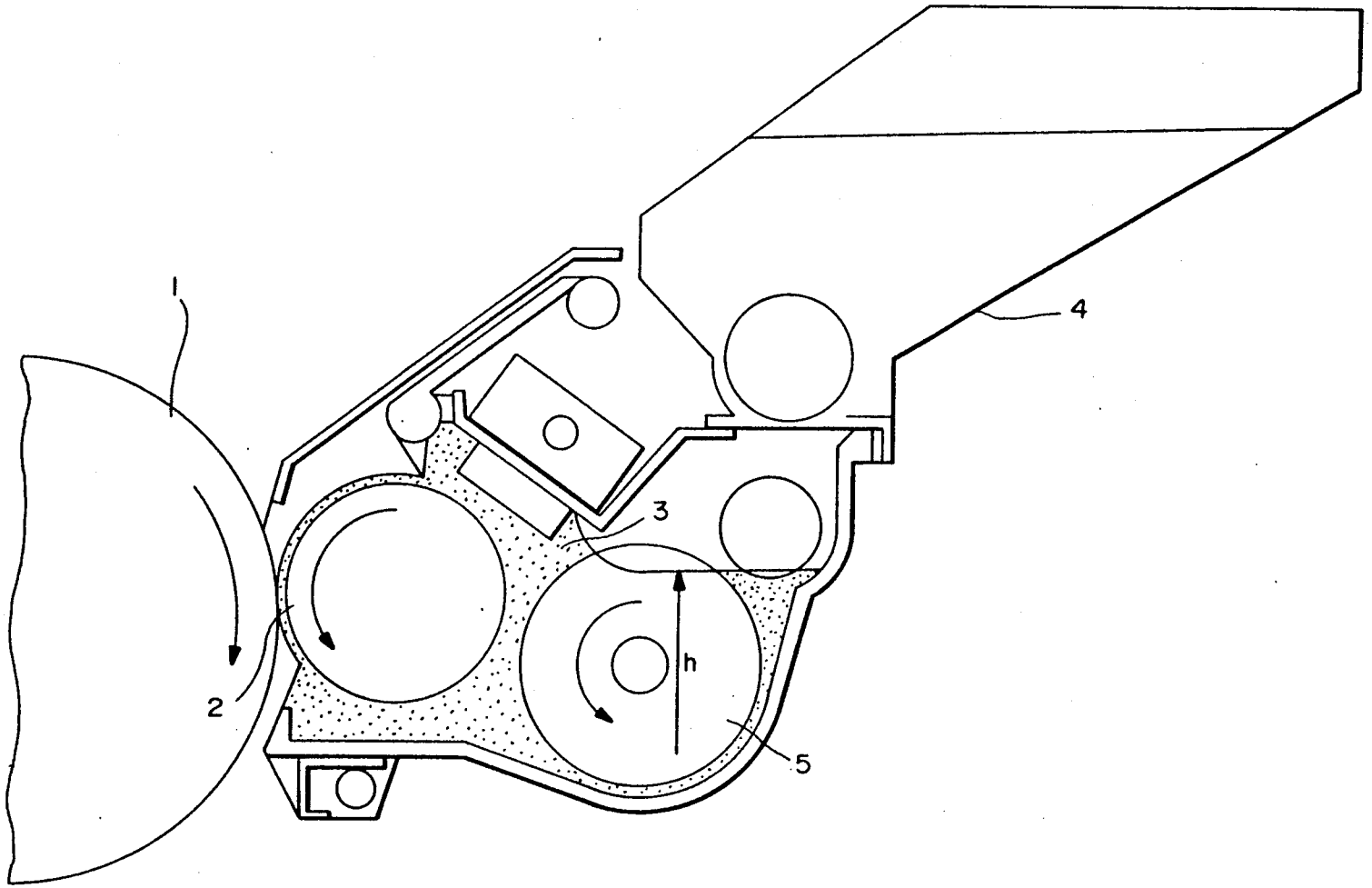
FIG. 4 is a sectional side view of a developing device for electrophotography in which a stirrer roller of the present invention may be used.
Figure 5:
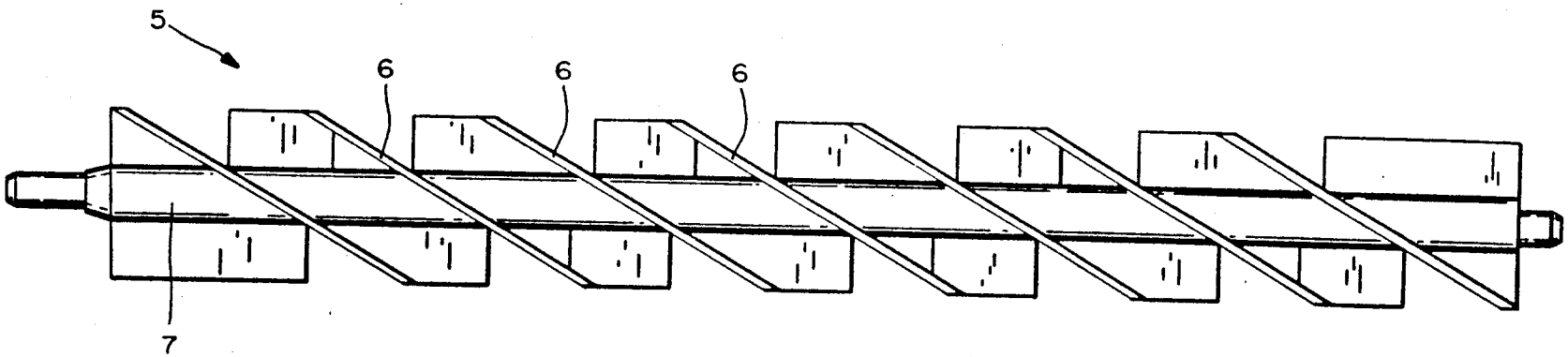
FIG. 5 is a plan view of a stirrer roller considered previously.
Figure 6:
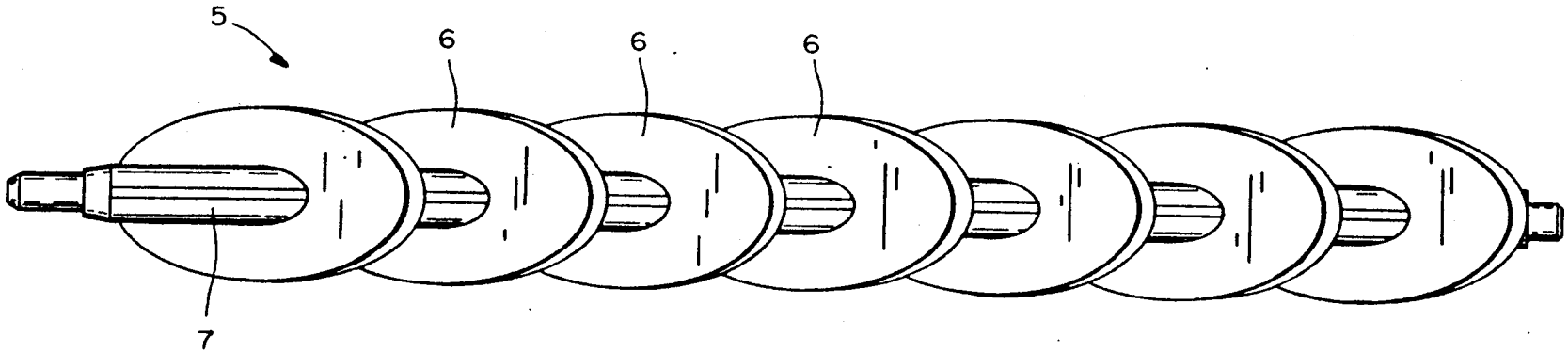
FIG. 6 is a front view of the stirrer roller of FIG. 5.

As shown in FIG. 4, this stirring roller 5 is disposed behind the developing roller 2 and rotates in the same direction therewith to stir the developing agent 3. In this operation, the developing agent can move axially through the notches 8. Since the notches 8 are symmetrically located, furthermore, the developing agent moves in two directions between each pair of plates 6 and its motion in the axial direction remains balanced. In addition, since the trajectories of the notches 8 do not overlap as the stirrer roller rotates, the portion of the developing agent 3 which passes through one of these notches 8 becomes pushed toward the periphery by the part of the plate 6 which is symmetrically opposite with respect to the major axis of the ellipse such that the height h is not reduced. In short, the stirrer roller 5 of this invention can stir the developing agent evenly and reliably both locally and as a whole such that the quality of images in electrophotography can be improved.

What is claimed is:

1. A stirrer roller of a developing device for electrophotography, comprising an axis, and a plurality of elliptical plates obliquely attached to said axis such that said plates are mutually parallel and that the projections of said elliptical plates in the direction of said axis are circles, each of said plates having notches which are symmetrically positioned with respect to the center thereof such that the trajectories of said notches do not overlap as said roller is rotated around said axis.

2. The stirrer of claim 1 wherein said notches are U-shaped.

3. The stirrer roller of claim 1 wherein said notches are elongated and extend parallel to the minor axis of said elliptical plate.

4. The stirring roller of claim 1 wherein said notches are at least as deep as they are wide.

5. The stirring roller of claim 3 wherein said notches are at least as deep as they are wide.

6. The stirring roller of claim 1 wherein said axis supports said elliptical plates at the centers of said elliptical plates.

* * * * *